US006178591B1

(12) United States Patent
Dussourd

(10) Patent No.: US 6,178,591 B1
(45) Date of Patent: Jan. 30, 2001

(54) DUST FREE AND NOISE IMPROVED VACUUM CLEANER MODULE

(76) Inventor: Jules L. Dussourd, 14 Cleveland Rd. 3 West, RD #2, Princeton, NJ (US) 08540

( * ) Notice: Under 35 U.S.C. 154(b), the term of this patent shall be extended for 0 days.

(21) Appl. No.: 09/300,337

(22) Filed: Apr. 27, 1999

(51) Int. Cl.[7] ..... A47L 9/00
(52) U.S. Cl. ..... 15/339; 15/323; 15/326
(58) Field of Search ..... 15/323, 326, 339, 15/327.5, 246.2; 416/247 R

(56) References Cited

U.S. PATENT DOCUMENTS 2,270,579 * 1/1942 Chamberlin et al. ..... 15/322 X
2,595,752 * 5/1952 Batts ..... 15/327.5 X
2,635,278 * 4/1953 Belknap ..... 15/353
3,505,791 4/1970 Breslin .
3,705,437 12/1972 Rukavina, Jr. et al. .
4,222,318 * 9/1980 Patton et al. ..... 416/247 R X
4,267,618 * 5/1981 Cuscovitch ..... 15/246.2 X
5,382,136 * 1/1995 Wang ..... 416/247 R

* cited by examiner

*Primary Examiner*—Chris K. Moore
(74) *Attorney, Agent, or Firm*—Arthur L. Plevy; Buchanan Ingersoll PC

(57) ABSTRACT

A vacuum cleaner module including a vacuum blower head and a support assembly for positioning in an opening defined between a movable window and a corresponding window sill of a building. The support assembly mounts the blower head outside the building adjacent to the movable window and the window sill when the support assembly is positioned in the opening. Some embodiments of the vacuum cleaner further include a cyclone separator and silencer which communicates with the fan outlet of the vacuum blower head for reducing emission of dust and noise from the vacuum blower head. Other embodiments of the vacuum cleaner module further include a muffler for attenuating suction noise generated by the vacuum blower head.

20 Claims, 9 Drawing Sheets

DUST FREE AND NOISE IMPROVED VACUUM CLEANER MODULE

FIELD OF THE INVENTION

This invention relates to cleaning devices, and in particular, to a vacuum cleaner module for positioning in a window wherein components of the module that are under positive pressure are outdoors and components of the module that are under vacuum are indoors.

BACKGROUND OF THE INVENTION

Conventional vacuum cleaners are designed to satisfy many requirements. Some ofthe more significant requirements include convenience, weight, cleaning thoroughness, appearance, and cost.

Unfortunately, these vacuum cleaners are extremely noisy and generate considerable afterdust that escapes through the filter pores and causes headaches and sinus infections in some individuals. Moreover, conventional vacuum cleaners require undesirable cleaning or replacement of the collector bags or tanks and are awkward, relatively heavy and often expensive.

Serious efforts have been made to address some of these problems, particularly by introducing multiple filters, electrostatic filters and the like to deal with afterdust. This has undesirably increased the size, cost and power requirements of these vacuum cleaners, without completely solving the afterdust problem or resolving the other problems. Additionally, the larger and heavier vacuum cleaners include self-propelling mechanisms which add to the cost and size of the vacuum cleaner.

Accordingly, there is a continuing need for a vacuum cleaner which effectively addresses the above problems.

SUMMARY OF THE INVENTION

A vacuum cleaner module comprising vacuum blower means and a support assembly for positioning in an opening defined between a movable window and a corresponding window sill of a building. The support assembly mounts the blower means outside the building adjacent to the movable window and the window sill when the support assembly is positioned in the opening.

Some embodiments of the vacuum cleaner further comprise dust separation means communicating with the vacuum blower means for reducing emission of dust from the vacuum blower means. The dust separation means can include vacuum blower outlet noise suppression means for reducing noise emitted from the vacuum blower means.

Other embodiments of the vacuum cleaner module further comprise suction noise attenuation means for attenuating suction noise generated by the vacuum blower means.

BRIEF DESCRIPTION OF THE DRAWINGS

The advantages, nature and various additional features of the invention will appear more fully upon consideration of the illustrative embodiments now to be described in detail in connection with the accompanying drawings wherein.

It is to be understood that these drawings are for purposes of illustrating the concepts of the invention and are not to scale.

DETAILED DESCRIPTION OF THE INVENTION

Figure 1A:
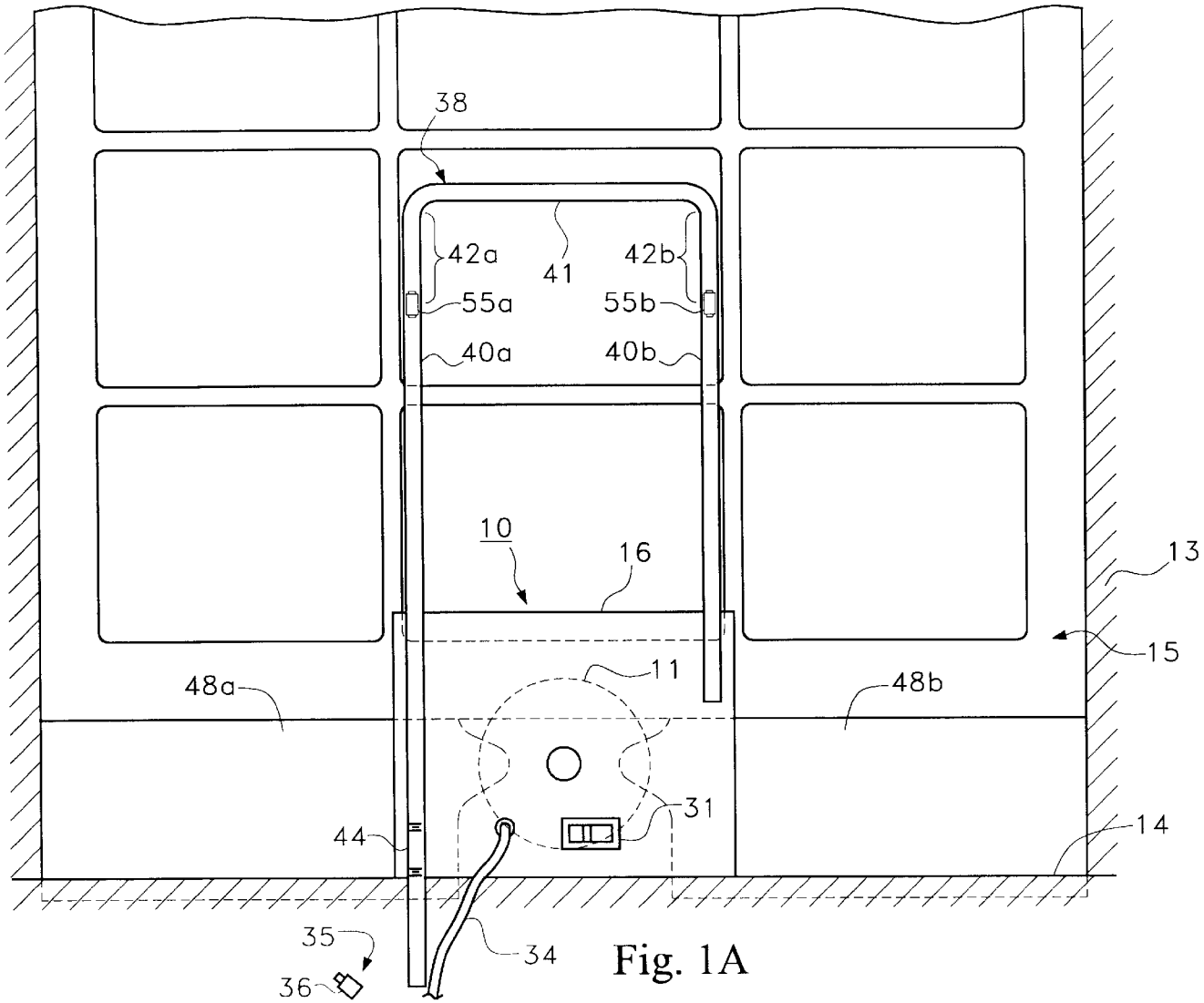
FIGS. 1A and 2A are front elevational views from inside a building, of a vacuum cleaner module according to an embodiment of the invention positioned in a conventional double hung window.
Figure 1B:
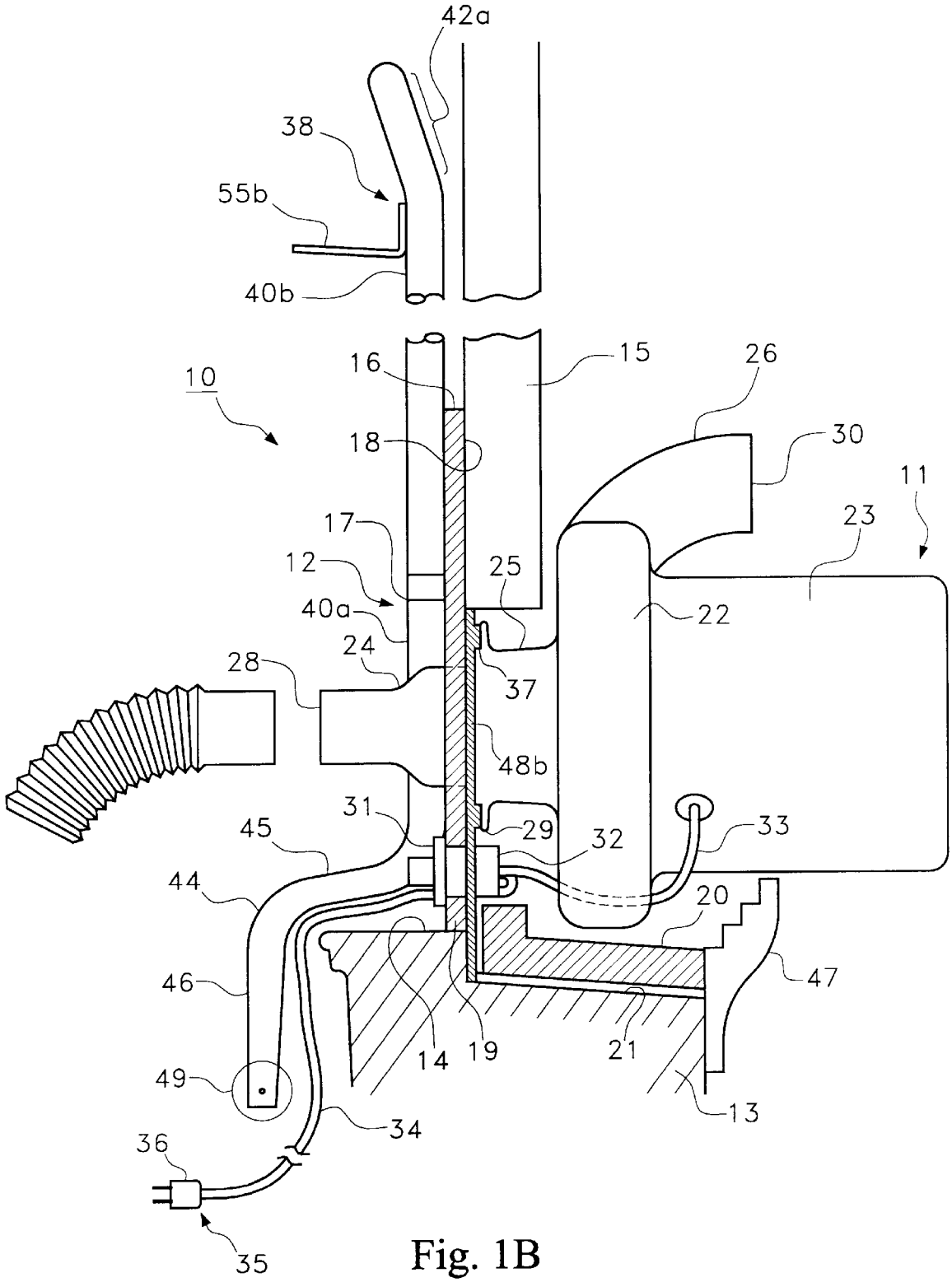
FIGS. 1B and 2B are side elevational views ofthe vacuum cleaner module of FIGS. 1A and 2A positioned in the window.

FIGS. 1A and 1B collectively illustrate a dust and noise free vacuum cleaner module 10 according to a first embodiment of the invention. The module 10 generally includes a vacuum blower head 11 mounted to a support assembly 12. The support assembly 12 positions the module 10 within an opening defined between a window sill 14 of a typical window frame 13 and a movable window 15 supported by the frame 13.

The support assembly 12 includes a vertically disposed blower head support panel 16 having a interior side 17, a exterior side 18, and an L-shaped locating member 20 extending from the exterior side 18 of the support panel 16 adjacent a bottom thereof 19. The locating member 20 is disposed at an angle θ, relative to the support panel 16, that is slightly greater than 90° to adapt the support assembly 12 to the downward slope of an outer portion 21 of the window sill 14.

As illustrated in FIG. 1B, the vacuum blower head 11 includes a blower 22 having a fan inlet 25 and a fan outlet 26, a motor 23 that powers the blower 22, and an elongated suction nozzle 24 that communicates with the fan inlet 25. Because the exact structure and operation of such vacuum blower heads are conventional and well known, no other details need be provided herein. The fan inlet 25 includes a circumferentially extending flange 29 that abuts through vibration absorber 37 against and is secured to the exterior side 18 of the support panel 16 using conventional screw fasteners (not shown) or other like means thus, securing the blower head 11 to the support assembly 12. The suction nozzle 24 extends from the fan inlet 25, through the exterior side 18 of the support panel 16 to the interior side 17 thereof. The suction nozzle 24 has an opening 28 which faces inside the building. The fan outlet 26 curves away from the blower 22 so that its opening 30 faces away from the exterior side 18 of the support panel 16.

Referring again to both FIGS. 1A and 1B, a conventional electrical power switch 31 for switching the vacuum blower head 11 on or off, is mounted on the interior side 17 of the support panel 16. A rear portion 32 ofthe switch 31 extends through the support panel 16 to the exterior side 18 thereof, and a power cable 33 electrically couples the switch 31 to the vacuum blower head 11. A conventional electrical power cord 34 originating from the rear portion 32 of switch 31 and passes through the exterior side 18 of support panel 16 and exits the interior side 17 thereof. The terminal end 35 of the power cord 34 includes a conventional plug 36 for connecting the vacuum blower head 11 to an electrical outlet. A handle assembly 38 is mounted on the interior side 17 of the support panel 16 using conventional fasteners (not shown) or other suitable means. The handle assembly 38 includes a horizontally spaced pair of upwardly extending arm members 40*a*, 40*b*. The upper portions 42*a*, 42*b* of the arm members 40*a*, 40*b* curve away from the interior side 17 of the support panel 16 and are connected by a horizontally disposed handle 42. At least one of the arm members 40*a*, 40*b* (arm member 40*a* in the drawings) includes an optional safety extension 44 having a first portion 45 which curves away from the interior side 17 of the support panel 16 and a second portion 46 that curves down and extends below the window sill 14. The safety extension 44 aids in positioning the module 10 within the opening between the window 15 and the window sill 14 and may be equipped with wheels 49. In particular, the safety extension 44 operates to positively locate the module 10 within the opening of a window when the window has no storm window frame. For windows having storm window frames (such as illustrated in the drawings and identified by numeral 47), the safety extension 44 provides an additional margin of safety which insures against accidental mishandling of the module 10.

Figure 2A:
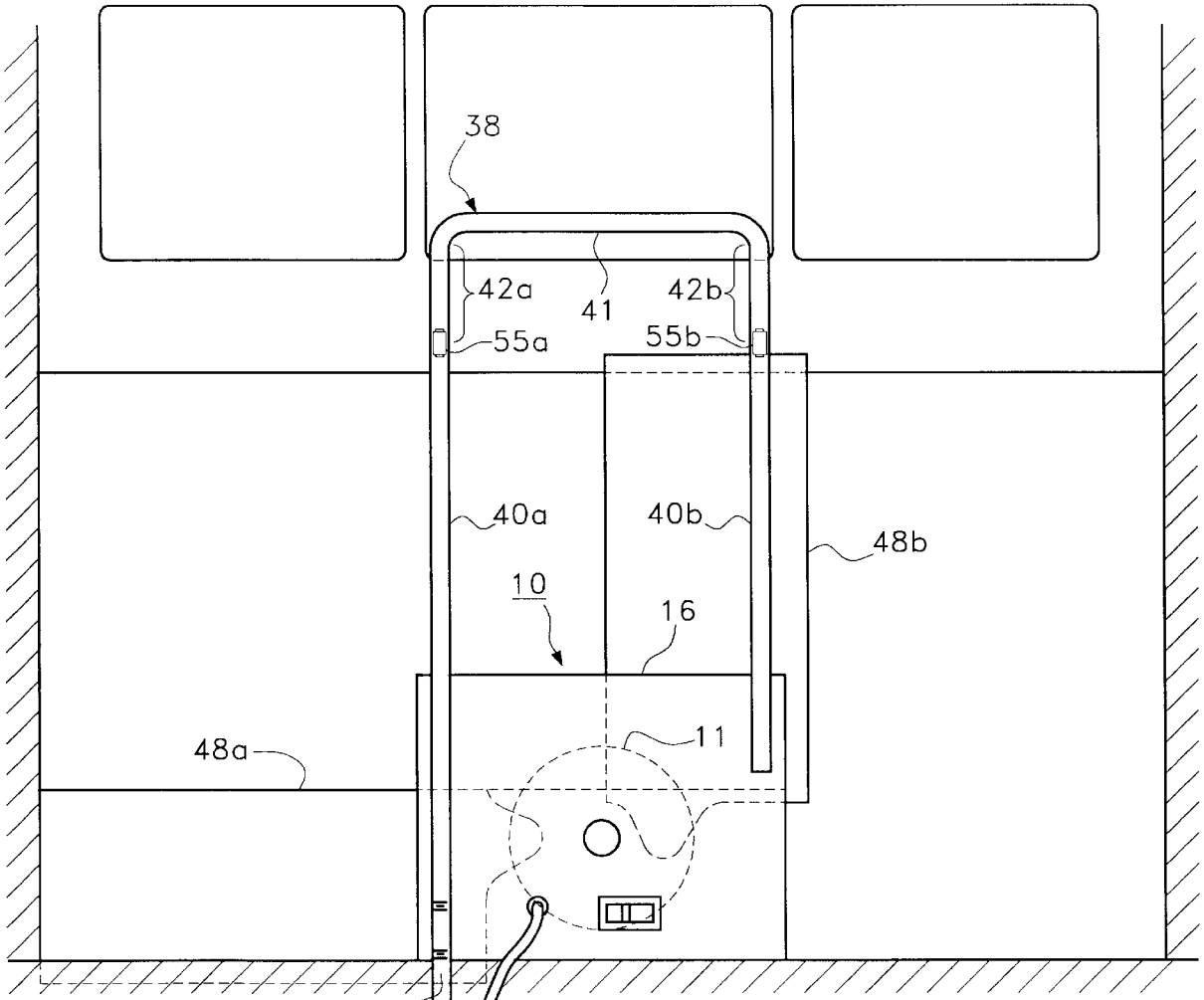
Figure 2B:
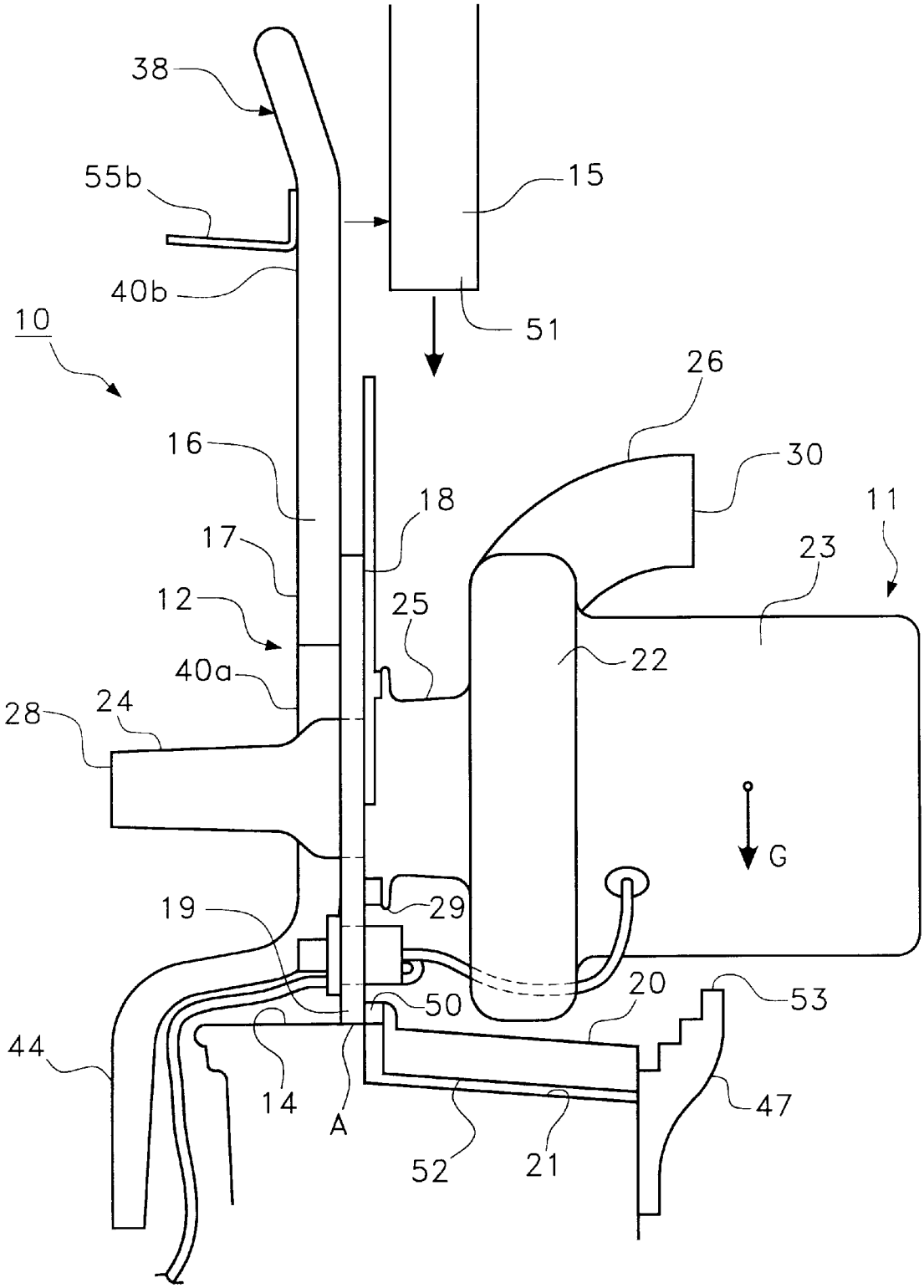

As illustrated in FIGS. 2A and 2B, the arm members 40*a*, 40*b* are of a length which positions their upper portions 42*a*, 42*b* and the handle 41 above maximum raised height of the lower edge 43 of the movable window 15. The permits the module 10 to be operated with window 15 raised at its maximum height if so desired.

Figure 3B:
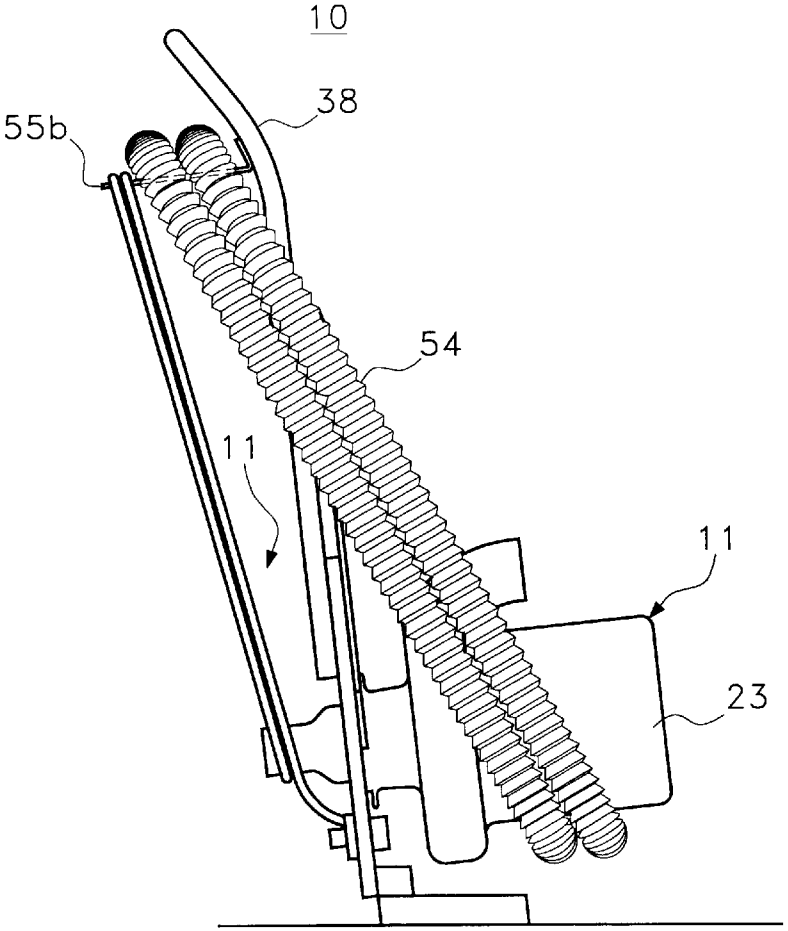
FIGS. 3A and 3B are front and side elevational views ofthe vacuum cleaner module of FIG. 1A illustrating its storage.
Figure 3A:
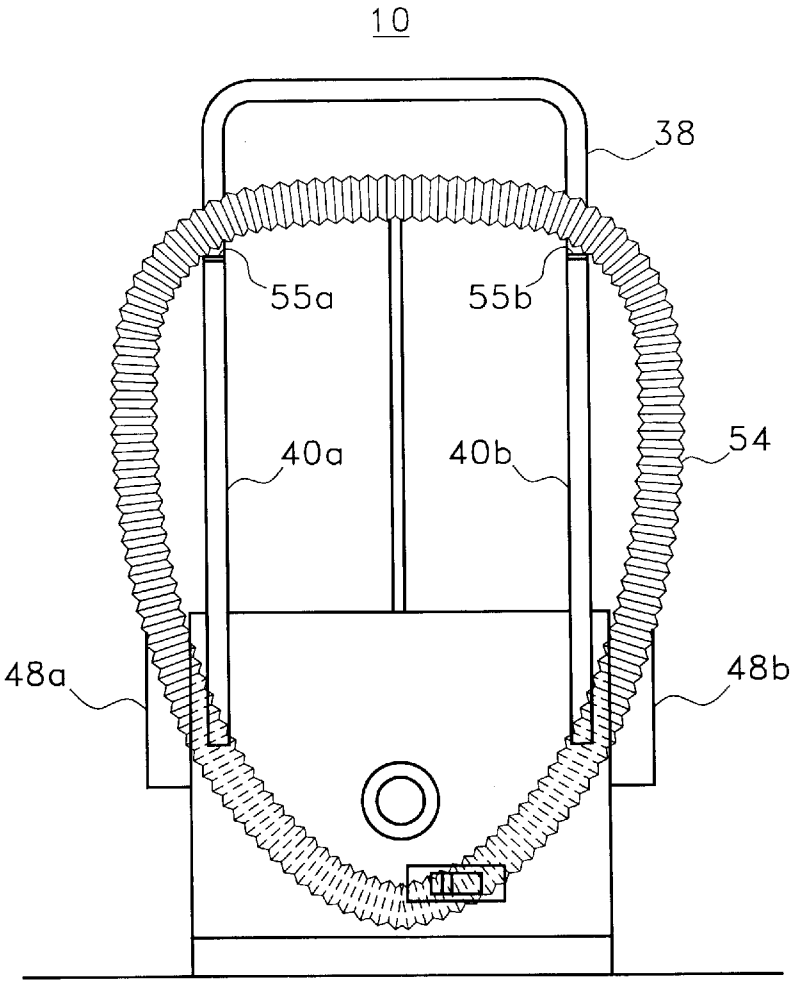

Referring particularly to FIGS. 1A and 2A, the support assembly further includes two vertically disposed side panels 48*a*, 48*b*. The side panels 48*a*, 48*b* are pivotally attached to the exterior side 18 of the support panel 16 so that they can be oriented in either a raised position or a lowered position (side panel 48*a* is illustrated in the lowered position and side panel 48*b* is illustrated in the raised position). In the raised position, the side panels 48*a*, 48*b* rotate behind the handle assembly 38 to permit the module 10 to be easily positioned in or removed from the opening under the window 15. The side panels 48*a*, 48*b* in the raised position also permit the module to be conveniently stored when not in use (FIGS. 3A and 3B). In the lowered operating position, the side panels 48*a*, 48*b* extend laterally beyond the side edges of the support panel 16 to seal the openings on each side thereof. Slots 50 disposed at the juncture of the support panel 16 and the locating member 20 (FIG. 2B) enable the side panels 48*a*, 48*b* to be rotated into the lowered position.

The support panel 16, locating member 20 and side wings 48*a*, 4*b* can be made from any suitable material or combination of materials including but not limited to metal, plastic and wood. Further, the support panel 16 and locating member 20 can be made as a unitary single unit or can be made as separate components which are then appropriately connected using any conventional fastening method.

In FIG. 2B, the module 10 is maneuvered into place for window mounting by placing the bottom 19 of the support panel 16 on the inner portion of the window sill 14 at location A. The module 10 is then pivoted toward the opening until the locating member 20 is disposed in the space overlying the outer portion 21 of the sill 14 in front of the storm window frame 47, and the handle assembly 38 contacts the lower inner surface 51 of the window 15. The support panel 16 and the locating member 20 are arranged so that a first gap 52 is disposed between the locating member 20 and the outer portion of the sill 14 and a second gap 53 is disposed between the motor 23 of the blower head 11 and the storm window frame 47 thus, allowing the weight of the module 10 to be carried by the support panel 16 at location A. The module's 10 center of gravity G and handle assembly 38 which overlaps the fully raised window 15 advantageously permits safe and convenient window mounting.

Once the module 10 is mounted as illustrated in FIG. 1B, a conventional flexible suction hose 54 is connected to the suction nozzle 24 of the blower head 11 and used for vacuuming carpets, floors, furniture, and the like. Both the suction hose 54 and the suction nozzle 24 can be adapted to include an integrally disposed power cable for powering a conventional beater brush assembly (not shown) that can be coupled at the free end of the suction hose 54.

FIGS. 3A and 3B illustrate the storage of the module 10 and suction hose 54. The side panels 48*a*, 48*b* are rotated in the raised position and the suction hose 54 is wrapped around holding brackets 55*a*, 55*b* provided on the arm members 40*a*, 40*b* of the handle assembly 38 and the motor 23 of the vacuum blower head 11. The power cord is also wrapped around the holding brackets 55*a*, 55*b*.

Figure 4:
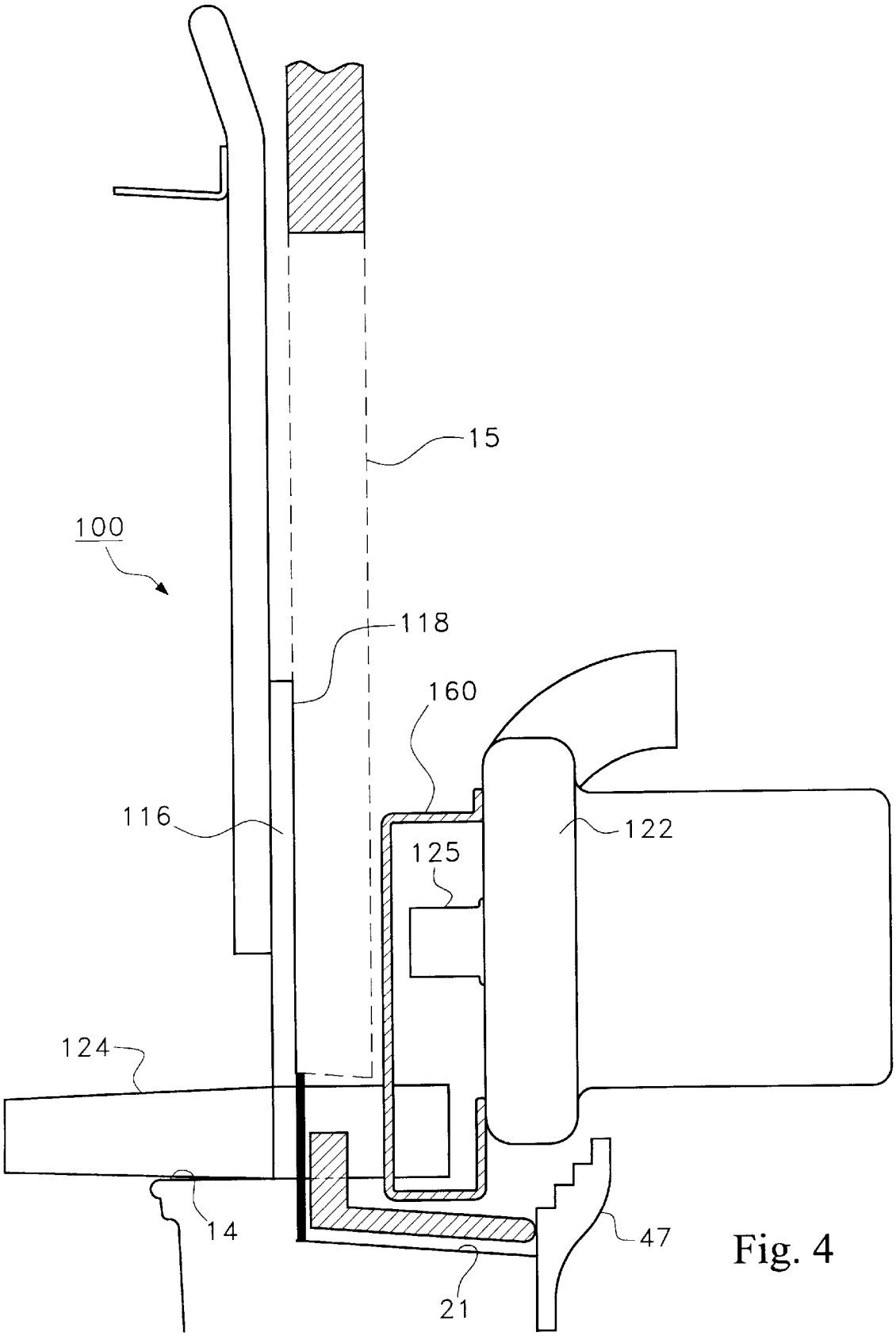
FIG. 4 is a side elevational view of a vacuum cleaner module according to a second embodiment positioned in a conventional double hung window.
Figure 5:
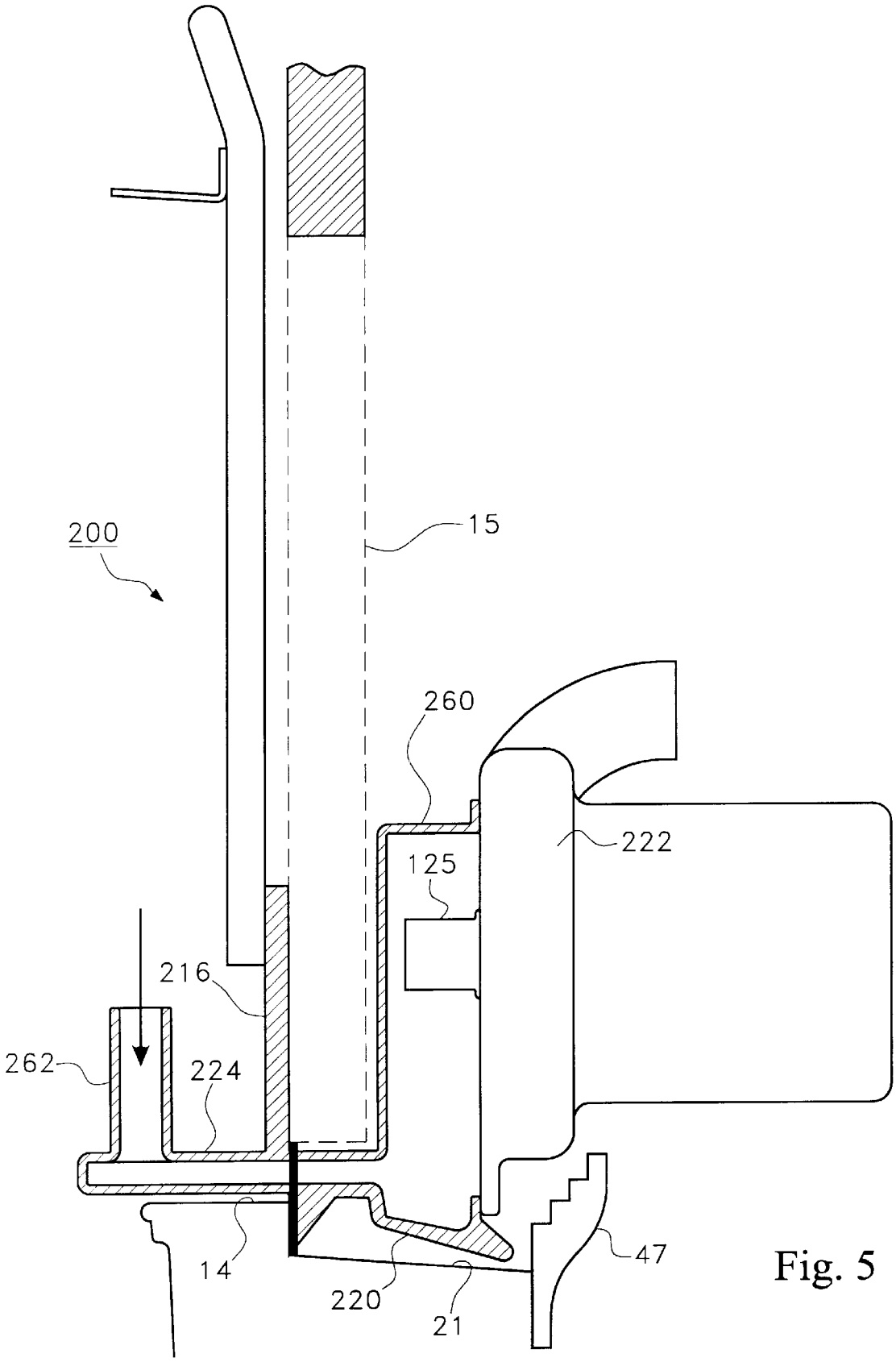
FIG. 5 is a side elevational view of a vacuum cleaner module according to a third embodiment positioned in a conventional double hung window.

FIGS. 4 and 5 illustrate vacuum cleaner modules 100, 200 according to second and third embodiments of the invention. In both the second and third embodiments, the module 100, 200 includes a silencing muffler 160, 260 disposed on the exterior side 118, 218 of the support panel 116, 216 between the suction nozzle 124, 224 and the fan inlet 125, 225 of the blower 122, 222. The muffler 160, 260 attenuates much of the noise which otherwise radiates directly from the fan inlet 125, 225 into the suction hose and hence the room during operation of the module 100, 200. The suction nozzle 124, 224 in each embodiment is downwardly offset relative to the support panel 116, 216 thereby, minimizing the height of the openings on each side of the module 100, 200, and permitting a corresponding height reduction in the module's side panels 148, 248. The differences in modules 100, 200 lie in the construction details of the suction nozzles 124, 224 and the mufflers 160, 260. In the second embodiment of FIG. 4, the suction nozzle 124 and muffler 160 are integrally attached but separate components. In the third embodiment of FIG. 5, the suction nozzle 224, support panel 216, locating member 220 and muffler 260 are unitarily formed as a single molded unit for simplicity and cost reduction purposes. Moreover, the suction nozzle 224 in the third embodiment is rectangular in shape to provide a lower profile height than the suction nozzle 124 in the second embodiment of FIG. 4, while maintaining an equivalent flow area thereto. The suction nozzle 224 in the third embodiment includes an upwardly extending nozzle 262 inlet for connecting a suction hose. Because the suction nozzle 224 has such a low profile height, very shallow side panels 248 can be used for sealing the openings on the sides of the support panel 216. It is also possible to use soft tubing in lieu of the flat side panels in the third embodiment.

As should be apparent, the vacuum cleaner module of the invention advantageously locates the vacuum blower head outside the window and the suction hose inside the window so that all the components of the vacuum blower head which are under position pressure are outdoors and all components which are under vacuum are indoors. Hence, the discharge of the blower, with its dust load and all its joints and connections from which dust can leak out are outdoors. Conversely, all the joints and connections remaining indoors (the suction hose, suction nozzle, etc.), are under a vacuum so that no dust can be emitted. Additionally, the blower, motor and fan outlet, which are the main sources of noise, are located outdoors. Moreover, there are no bags or tanks to be handled, emptied or cleaned. Furthermore, the module of the invention is simple to operate and mount, is light and compact in comparison to conventional vacuum cleaners and relatively inexpensive to manufacture.

Figure 6:
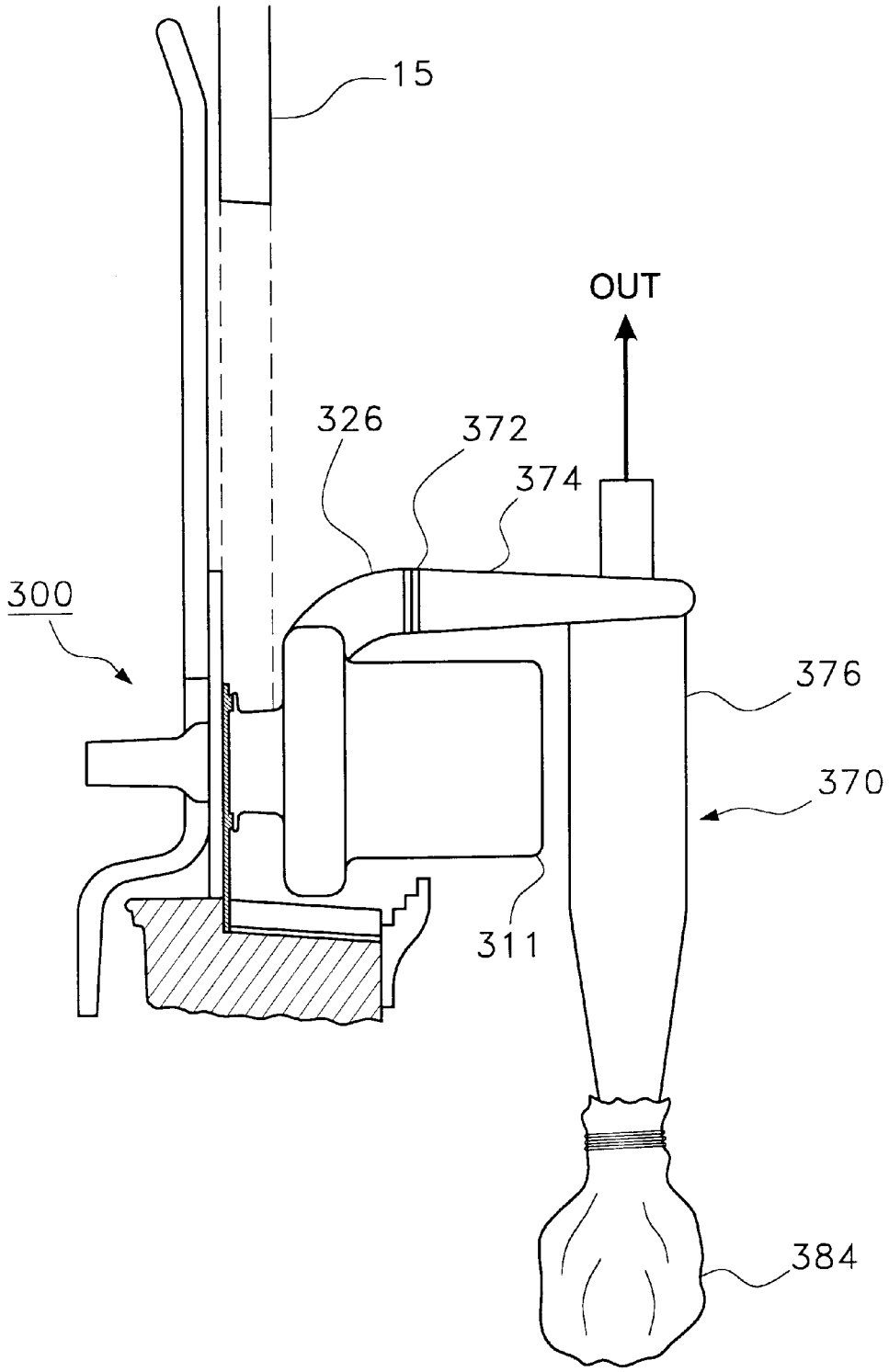
FIG. 6 is a side elevational view of a vacuum cleaner module according to a fourth embodiment positioned in a conventional double hung window.

FIG. 6 illustrates a vacuum cleaner module 300 according to a fourth embodiment of the invention which is useable in areas which have environmental regulations which strictly limit the amount of dust and noise which can be emitted from vacuum cleaner devices operated outdoors. The module 300 includes a cyclone separator and silencer 370 (separator 370) coupled to the fan outlet 326 using a conventional swivel coupler 372. The separator 370 reduces the emission of dust and noise from the fan outlet 326 of the vacuum blower head 311.

Figure 7:
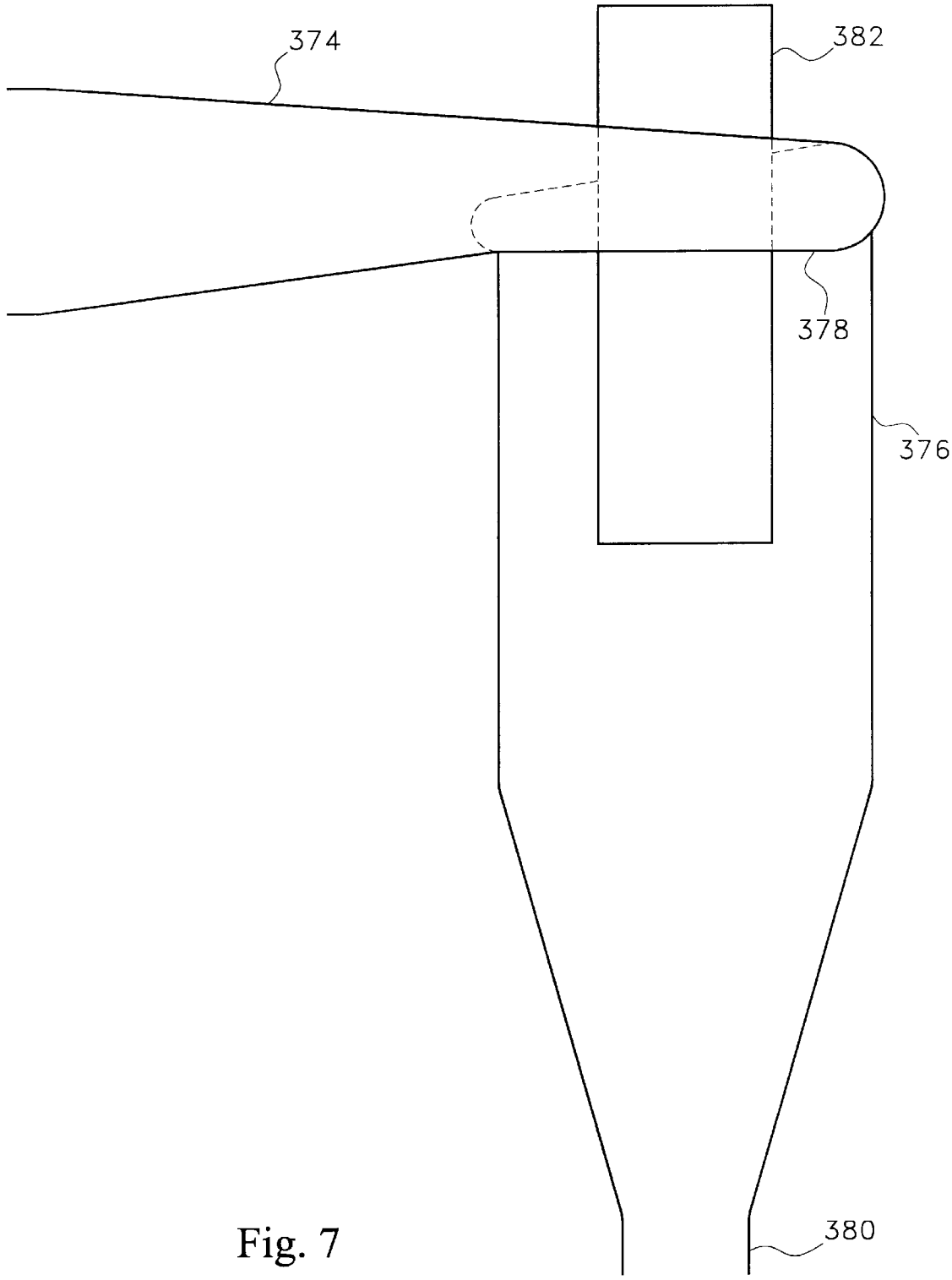
FIG. 7 is an enlarged elevational view of a conventional cyclone separator and silencer as illustrated in FIG. 6.

As illustrated in FIG. 7, the separator 370 includes a noise silencing housing 376 which contains a typical cyclone generator 378. The separator 370 has an inflow inlet 374 which communicates with the fan outlet 326 of the vacuum blower head 311. The cyclone generator 378 receives air entering through the inflow inlet 374 from the vacuum blower head 311 and centrifuges dust contained therein and discharges a small concentrated air stream at the bottom of the separator 370 through an under flow outlet 380. The bulk of the cleaned air is blown out at the top of the separator 370 via an overflow outlet 382. The small under flow exiting the under flow outlet 380 can be collected in a small bag 384 attached thereto as illustrated in FIG. 6 or can be sent through a hose (not shown) into shrubbery around the building, to outdoor flower boxes or any safe or authorized discharge location. Because the separator 370 is swivel mounted to the vacuum blower head 311 via the swivel coupler 372, it can be rotated for storage or into any desired position to permit easy access to the collection bag 384.

While the foregoing invention has been described with reference to the above embodiments, various modifications and changes can be made without departing from the spirit of the invention. Accordingly, these modifications and changes are considered to be within the scope of the claims.

What is claimed is:

1. A vacuum cleaner module comprising:

a vacuum blower head; and a support assembly for positioning in an opening defined between a movable window and a corresponding window sill of a building, the vacuum blower head being attached to the support assembly, the support assembly mounting the blower head outside the building adjacent to the movable window and the window sill when the support assembly is positioned in the opening.

2. The vacuum cleaner module according to claim 1, wherein the support assembly includes a support panel which mounts the vacuum blower head and seals at least a portion of the opening.

3. The vacuum cleaner module according to claim 2, wherein the support panel includes a first side which faces inside the building when the support assembly is positioned in the opening and a second side which faces outside the building when the support assembly is positioned in the opening.

4. The vacuum cleaner module according to claim 3, wherein the support assembly further includes a handle assembly mounted to the first side of the support panel.

5. The vacuum cleaner module according to claim 4, wherein the handle assembly extends up from the support panel so that when the support assembly is positioned in the opening, a portion of the handle assembly is above the bottom of the movable window at its maximum open height.

6. The vacuum cleaner module according to claim 4, where the handle assembly includes means for hanging a suction hose thereon.

7. The vacuum cleaner module according to claim 2, wherein the support assembly further includes at least one side panel extending laterally from the support panel, the at least one side panel sealing a remaining portion of the opening.

8. The vacuum cleaner module according to claim 7, wherein the support panel includes a first side which faces inside the building when the support assembly is positioned in the opening and a second side which faces outside the building when the support assembly is positioned in the opening, the at least one side panel is pivotally mounted to the second side of the support panel.

9. The vacuum cleaner module according to claim 2, further comprising a suction nozzle extending from the vacuum blower head through the support panel, the suction nozzle having a free end which is inside the building when the support assembly is positioned in the opening, and a suction hose which detachably couples to the suction nozzle of the vacuum blower head.

10. The vacuum cleaner module according to claim 9, further comprising suction noise attenuation means disposed between the suction nozzle and the vacuum blower head.

11.The vacuum cleaner module according to claim 10, wherein the suction nozzle and noise attenuation means are a unitary unit.

12. The vacuum cleaner module according to claim 10, wherein the suction noise attenuation means are disposed outside the building when the support assembly is positioned in the opening.

13. The vacuum cleaner module according to claim 1, wherein the support assembly further includes a handle assembly mounted thereto.

14. The vacuum cleaner module according to claim 13, wherein the handle assembly extends above the bottom of the movable window at its maximum open height when the support assembly is positioned in the opening.

15. The vacuum cleaner module according to claim 13, where the handle assembly includes means for hanging a suction hose thereon.

16. The vacuum cleaner module according to claim 1, further comprising dust separation means communicating with the vacuum blower head for reducing emission of dust from the vacuum blower head.

17. The vacuum cleaner module according to claim 16, wherein the dust separation means includes vacuum blower outlet noise suppression means.

18. The vacuum cleaner module according to claim 16, wherein the dust separation means is swivel-coupled to the vacuum blower head.

19. The vacuum cleaner module according to claim 16, further comprising one of a hose and collection bag coupled to the dust separation means for handling separated-out dust.

20. The vacuum cleaner module according to claim 1, further comprising a suction hose for use in cleaning inside the building, the hose detachably coupled to the vacuum blower head.

* * * * *